US009616300B2

(12) United States Patent
Motokawa

(10) Patent No.: US 9,616,300 B2
(45) Date of Patent: Apr. 11, 2017

(54) GOLF CLUB HEAD

(71) Applicant: DUNLOP SPORTS CO. LTD., Kobe-shi, Hyogo (JP)

(72) Inventor: Yuki Motokawa, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 253 days.

(21) Appl. No.: 14/500,117

(22) Filed: Sep. 29, 2014

(65) Prior Publication Data

US 2015/0094163 A1 Apr. 2, 2015

(30) Foreign Application Priority Data

Sep. 30, 2013 (JP) ..... 2013-204768

(51) Int. Cl.
*A63B 53/04* (2015.01)
*A63B 53/06* (2015.01)

(52) U.S. Cl.
CPC ..... *A63B 53/0466* (2013.01); *A63B 53/04* (2013.01); *A63B 53/06* (2013.01); *A63B 2053/0433* (2013.01)

(58) Field of Classification Search
USPC ..... 473/287–292, 324–350
See application file for complete search history.

(56) References Cited

U.S. PATENT DOCUMENTS 8,328,659 B2 * 12/2012 Shear ..... A63B 53/0466 473/329
8,403,771 B1 * 3/2013 Rice ..... A63B 53/04 473/328
8,430,763 B2 4/2013 Beach et al.
8,858,360 B2 * 10/2014 Rice ..... A63B 53/04 473/329
8,956,242 B2 * 2/2015 Rice ..... A63B 53/0466 473/329
2014/0057738 A1 2/2014 Albertsen et al.
2014/0080634 A1 * 3/2014 Golden ..... A63B 60/54 473/345

* cited by examiner

*Primary Examiner* — Nini Legesse
(74) *Attorney, Agent, or Firm* — Birch, Stewart, Kolasch & Birch, LLP

(57) ABSTRACT

A hollow golf club head comprises a face portion having a club face for hitting a ball, and a club face's perimeter region extending backwards from the face portion. The perimeter region is provided with at least one set of a front part extending backwards from the face portion to have a free rear end, and a rear part extending forwards to have a free front end. The front part and the rear part are overlapped with each other without being fixed to each other so that, relatively to the rear part, the front part is movable in the front-back direction of the club head when hitting a ball.

9 Claims, 18 Drawing Sheets

E1 cross section

GOLF CLUB HEAD

BACKGROUND OF THE INVENTION

The present invention relates to a golf club head, more particularly to a support structure mainly for the face portion capable of improving the rebound performance of the head.

U.S. Pat. No. 8,328,659 discloses a hollow golf club head having a face portion and a sole portion, wherein the sole portion is provided with a through slot near the face portion. Owing to the through slot, the face portion when hitting a ball can effectively deflect, and thereby the rebound performance can be improved. Such through slot may be closed by an elastomeric material not to hinder the deflection of the face portion.

U.S. Pat. Nos. 8,235,844 and 8,430,763 each disclose a hollow golf club head having a face portion and a sole portion, wherein the sole portion is provided with a groove or bottomed slot near the face portion in order to facilitate the deflection of the face portion when hitting a ball.

In the former golf club head, there is a problem with a dropping-off of the elastomeric material by the shocks at impact. In the later golf club heads, there is a problem such that the grooved part of the sole portion rises and the height of the center of gravity of the head is increased accordingly.

SUMMARY OF THE INVENTION

It is therefore, an object of the present invention to provide a golf club head in which the rebound performance can be improved without increasing the height of the center of gravity of the head and also without being annoyed by the dropping-off of the elastomeric material.

According to the present invention, a golf club head with a hollow therein comprises:

a face portion having a club face for hitting a ball, and a club face's perimeter region extending backwardly of the club head from the face portion, the club face's perimeter region provided with at least one set of a front part extending backwards from the face portion to have a free rear end in the back thereof, and a rear part extending forwards to have a free front end in the front thereof, wherein the front part and the rear part are overlapped with each other without being fixed to each other so that, relatively to the rear part, the front part is movable in the front-back direction of the club head when hitting a ball.

The golf club head according to the present invention may have the following features (1)-(9):

(1) the club head comprises a first head member having an opening, and a second head member closing the opening, the free rear end of the front part is formed by a part of an edge of the first head member surrounding the opening, and the free front end of the rear part is formed by a front edge of the second head member;

(2) the first head member comprises a sole portion forming a bottom surface of the club head, the opening is formed in the sole portion, and the front part is formed by a part of the sole portion between the face portion and the opening;

(3) the perimeter of the second head member excepting the free front end is fixed to the first head member;

(4) the rear part comprises a front section overlapping the front part and a rear section extending backwards from the front section, and the rear part extends without covering the outside of the free rear end of the front part;

(5) the rear part is bent towards the hollow so that the front section thereof is positioned on the inside of the front part;

(6) the first head member is cup-shaped and comprises the face portion and a turnback extending backwardly of the club head to form the club face's perimeter region, the free rear end is formed by at least a part of the rear edge of the turnback, the second head member is cup-shaped, and the hollow of the golf club head is formed by an open cavity of the second head member and an open cavity of the first head member;

(7) the turnback include a sole-side turnback provided with the free rear end;

(8) in a vertical cross section of the club head under its standard state passing through the center of gravity of the club head and being parallel to the front-back direction of the club head, the front part and the rear part have contact surfaces which are a circular arc whose center is positioned in the vicinity of the corner between the face portion and a crown portion of the club head;

(9) a concave portion is formed behind the free rear end of the front part and on the outside of the rear part, and an elastic material is disposed in the concave portion.

Therefore, the deflection of the face portion in the front-back direction of the club head when hitting a ball can be promoted by the motion of the front part in the front-back direction, thereby the golf club head according to the present invention can be improved in the rebound performance. Further, the front part and the rear part can be overlapped with each other without forming an opening which allows for foreign objects such as small stones, dirt and water to get into the hollow.

In this application including the description and claims, dimensions, positions, directions and the like relating to the club head refer to those under a standard state of the club head unless otherwise noted.

Here, the standard state of the club head is such that the club head is set on a horizontal plane so that the axis of the club shaft (not shown) is inclined at the specified lie angle while keeping the axis on a vertical plane, and the face forms the specified loft angle with respect to the horizontal plane. Incidentally, in the case of the club head alone, the center line of the shaft inserting hole can be used instead of the axis of the club shaft.

"Front-back direction" is a direction parallel with a straight line projected on the horizontal plane, wherein the straight line is drawn normally to the club face passing through the center G of gravity of the club head.

"Toe-heel direction" is a direction parallel with the horizontal plane and perpendicular to the front-back direction.

"Sweet spot SS" is the point of intersection between the club face and the straight line drawn normally to the club face passing the center G of gravity of the head.

BRIEF DESCRIPTION OF THE DRAWINGS

FIG. 17(*b*) is a cross sectional view taken along line C-C of FIG. 17(*a*).

DESCRIPTION OF THE PREFERRED EMBODIMENTS

Figure 1:
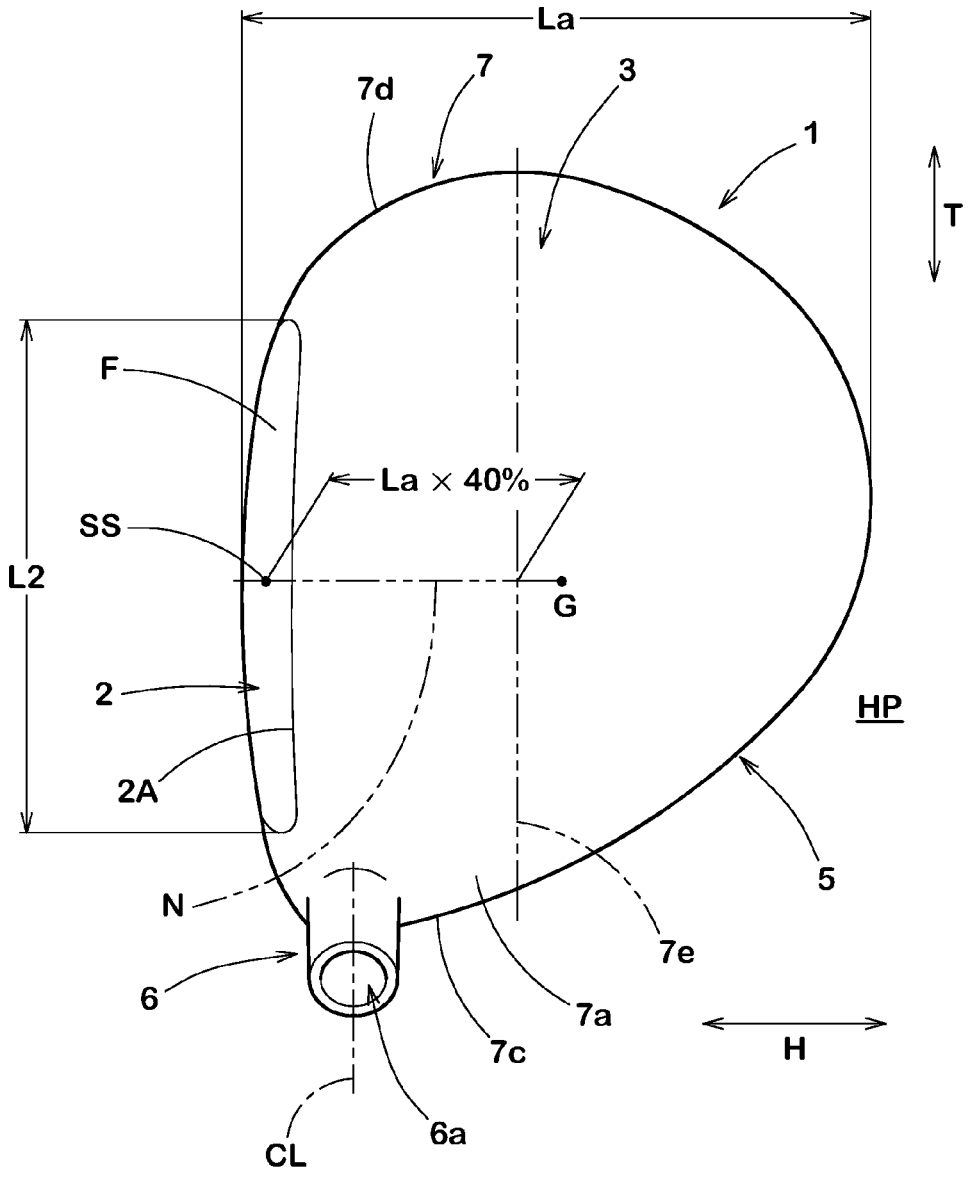
FIG. 1 is a top view of a golf club head as a first embodiment of the present invention.

Embodiments of present invention will now be described in detail in conjunction with accompanying drawings.

Throughout all of the embodiments, same members or portions are denoted by the same reference signs or numbers.

In the following embodiments, each club head 1 is for a wood-type club.

The term "wood-type club" is meant for at least driver (#1 wood), and fairway woods such as brassie (#2 wood), spoon (#3 wood), baffy (#4 wood) and cleek (#5 wood) are included. In addition, club heads having similar shapes to those wood-type club heads are included even if the number or name of the club is different from the above.

The club head 1 is, for example, made of one or more kinds of metal materials, e.g. stainless steel alloy, maraging steel, titanium, titanium alloy, magnesium alloy, aluminum alloy and the like. However, it is also possible that the club head 1 is partially formed by one or more kinds of fiber reinforced resins.

The club head 1 comprises a face portion 2, a crown portion 3, a sole portion 4 and a side portion 5.

The club head 1 has a hollow (i) therein.

The face portion 2 has a front surface defining a club face F for hitting a ball and a back surface B facing the hollow (i).

The crown portion 3 is continuous from the face portion 2 and forms a top surface of the club head.

The sole portion 4 is continuous from the face portion 2 and forms a bottom surface of the club head.

The side portion 5 extends between the crown portion 3 and the sole portion 4 and forms a side surface of the club head. The side portion 5 is connected to the face portion 2 on the toe-side and on the heel-side.

A hosel portion 6 is formed in a heel-side of the crown portion 3. The hosel portion 6 is tubular and provided with a shaft inserting hole 6*a* to be fixed to a golf club shaft (not shown).

The club head 1 has a club face's perimeter region 7 which is defined as extending backwardly of the club head from the face portion 2 so as to surround the face portion 2. Thus, the club face's perimeter region 7 includes a front region 7*a* of the crown portion 3, a front region 7*b* of the sole portion 4, a heel-side front region 7*c* of the side portion 5, and a toe-side front region 7*d* of the side portion 5.

Figure 2:
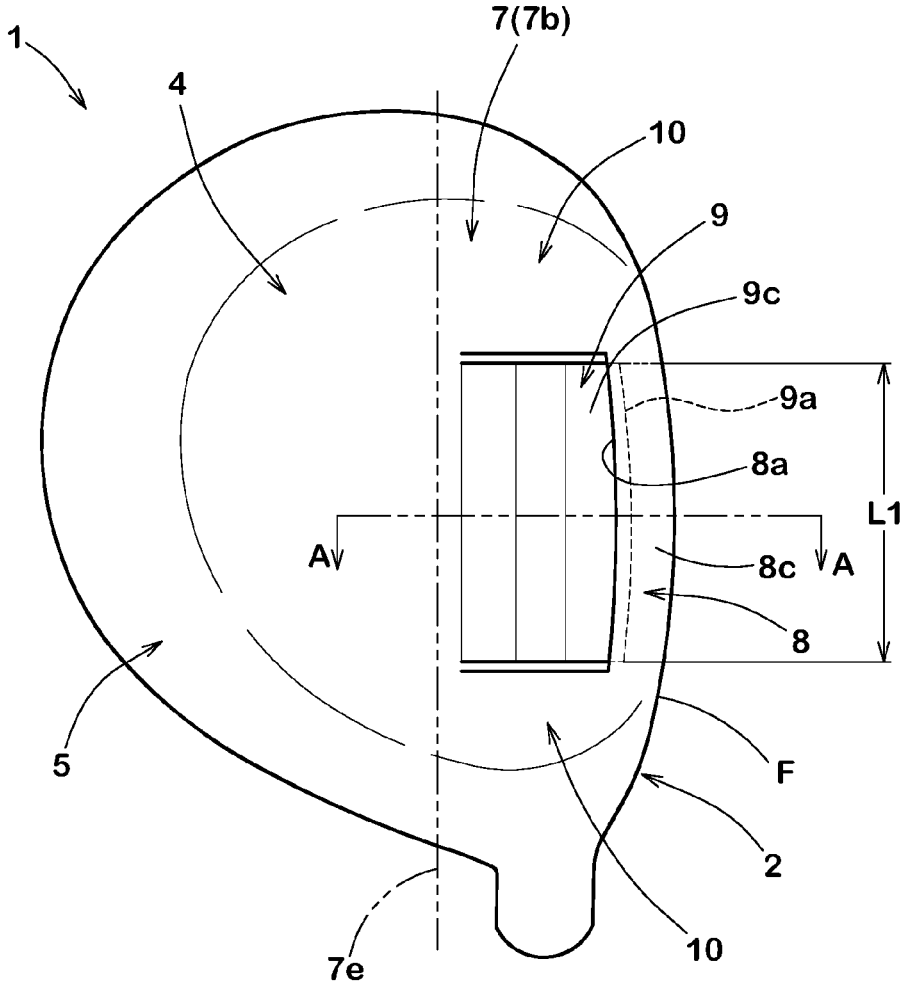
FIG. 2 is a bottom view thereof.

Preferably, the club face's perimeter region 7 is defined as extending backwardly from the peripheral edge 2A of the club face F by 40% of the maximum length La of the club head 1 in the front-back direction because such region can affect the deflection of the face portion 2 when hitting a ball. In FIG. 1 and FIG. 2, the imaginary line 7*e* indicates a preferable backward extent of the club face's perimeter region 7.

Figure 5A:
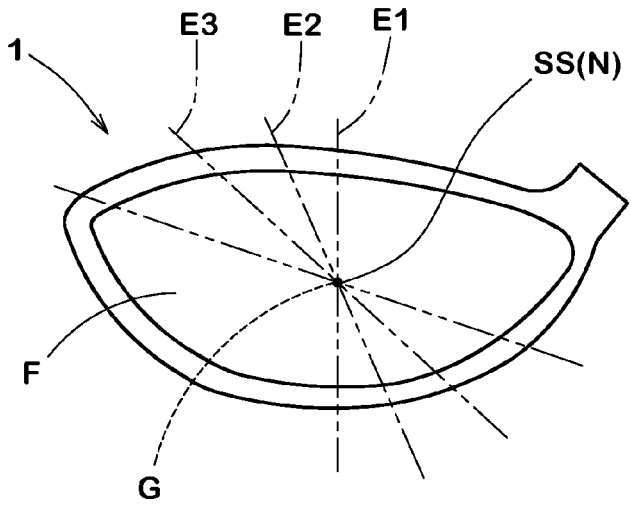
FIG. 5(*a*) and FIG. 5(*b*) are a front view and a cross sectional view of a golf club head for explaining the peripheral edge of the club face.
Figure 5B:
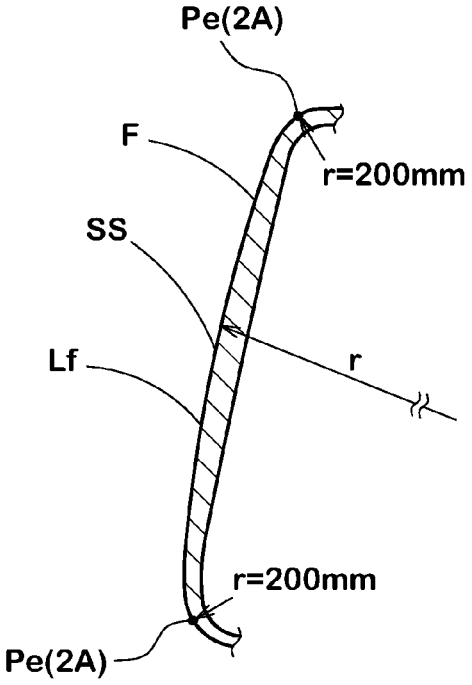

If the peripheral edge 2A of the club face F is unclear due to smooth change in the curvature, as shown in FIGS. 5(*a*) and 5(*b*), a virtual edge line (Pe) defined based on the curvature change is used instead as follows.

In each cutting plane E1, E2—including the sweet spot SS and the center G of gravity of the head, a point Pe at which the radius (r) of curvature of the profile line Lf of the face portion first becomes under 200 mm in the course from the sweet spot SS to the periphery of the club face is determined. Then, the virtual edge line is defined as a locus of such points Pe.

The club head 1 is provided in the club face's perimeter region 7 with a set of a front part 8 and a rear part 9.

Figure 3:
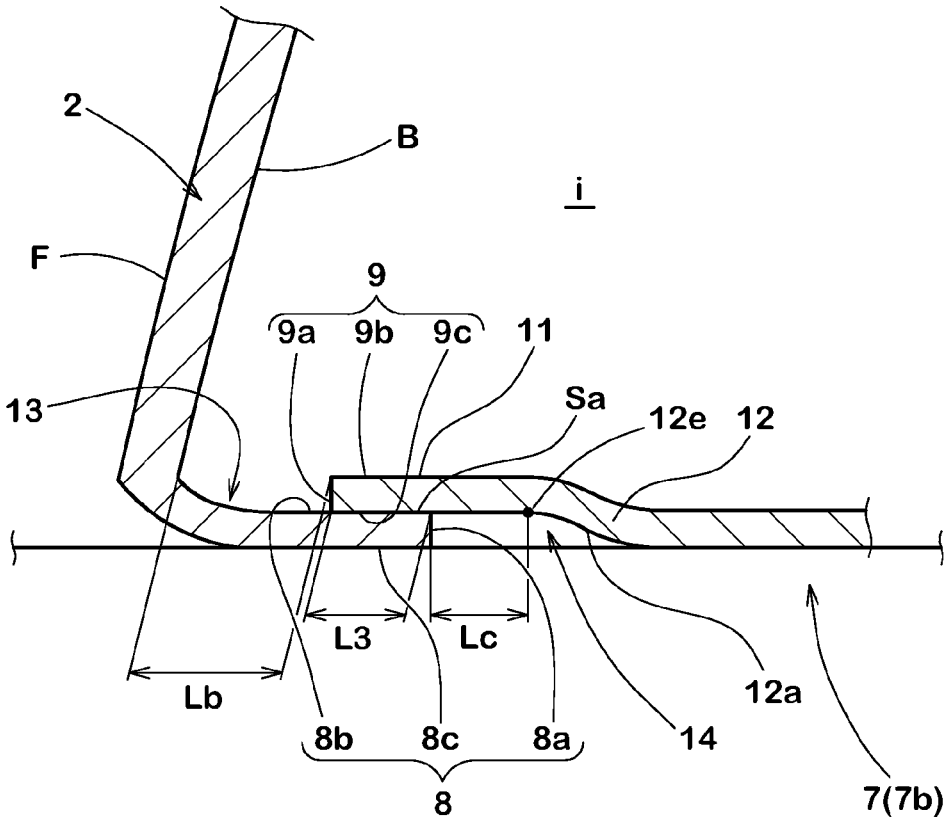
FIG. 3 is a cross sectional view taken along line A-A of FIG. 2.

In the embodiment shown in FIG. 2 and FIG. 3, a set of the front part 8 and rear part 9 is formed in the front region 7*b* of the sole portion 4.

The front part 8 extends backward from the face portion 2 and terminates within the perimeter region 7, and the rear part 9 extends frontward and terminates within the perimeter region 7.

The front part 8 and the rear part 9 overlap each other in the front-back direction of the head.

The front part 8 has a free rear end 8*a* extending in the toe-heel direction of the head, an inner surface 8*b* on the hollow (i) side, and an outer surface 8*c* on the opposite side thereof.

The rear part 9 has a free front end 9*a* extending in the toe-heel direction of the head, an inner surface 9*b* on the hollow (i) side, and an outer surface 9*c* on the opposite side thereof.

The rear part 9 has a front section 11 having the above-mentioned free front end 9*a* and overlapped with the front part 8, and a rear section 12 extending backwardly from the front section 11.

In this embodiment, the free front end 9*a* is disposed on the inside of the free rear end 8*a*.

The free front end 9*a* is spaced apart from the back surface B of the face portion 2.

Thus, the free rear end 8*a* of the front part 8 is not covered with the rear section 12.

Figure 4:
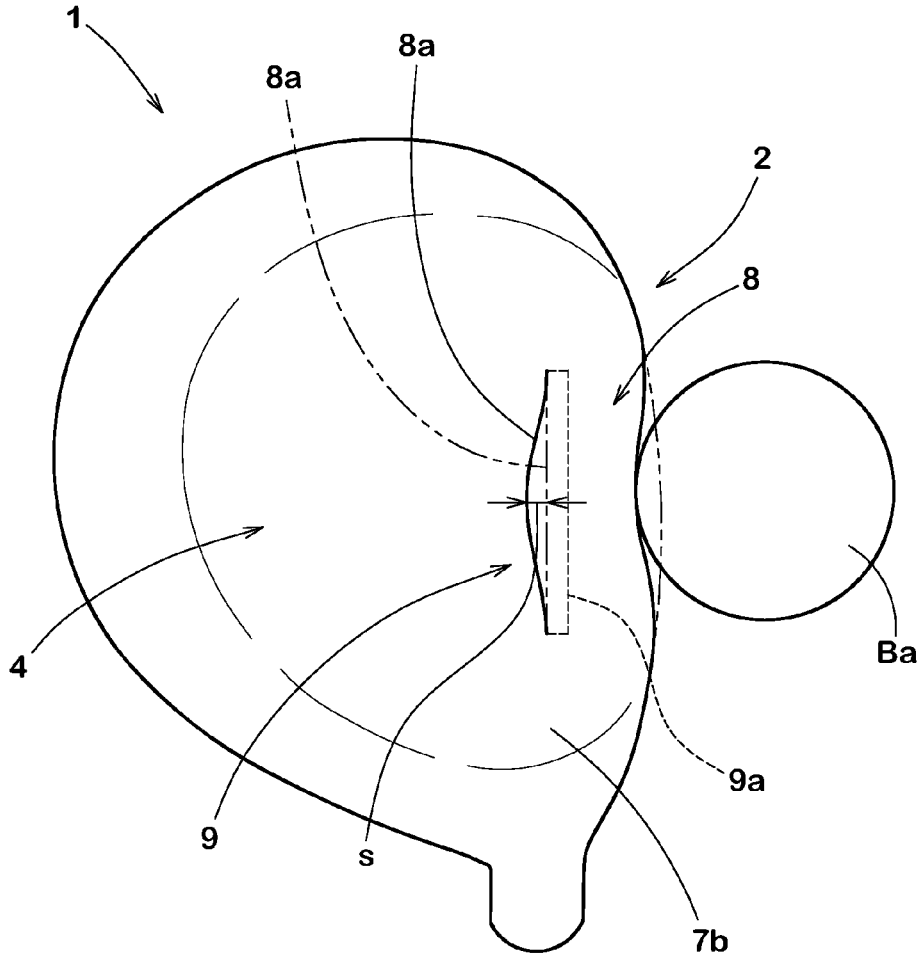
FIG. 4 is a diagrammatic bottom view of the golf club head for explaining the function of the overlapped front part and rear part to promote the deflection of the face portion when hitting a ball.

FIG. 4 exaggeratedly shows the influence of the front part 8 and the rear part 9 on the club head 1 when hitting a ball Ba, wherein the imaginary line shows the face portion 2 and the free rear end 8*a* before hitting the ball Ba.

Since, the front part 8 and the rear part 9 are not fixed to each other, and the free front end 9*a* is spaced apart from the back surface B, and further the free rear end 8*a* is not covered with the rear section 12, the front part 8 can move in the front-back direction (motion s) when hitting a ball, which allows for the face portion 2 to largely deflect in the front-back direction, and thereby the rebound performance can be improved.

The front part 8 and the rear part 9 are overlapped with each other so as to close the hollow (i) in substance, and thereby to prevent foreign substances such as small stones, dirt and water from entering into the hollow (i).

In this embodiment, as shown in FIG. 3, in the overlap between the front part 8 and the rear part 9, their opposing surfaces sa closely contact each other in order to surely prevent the entering of foreign substances into the hollow (i).

In general, the sole portion of a club head has a thickness larger than those of the crown portion and the side portion in order to relatively increase the strength of the sole portion having a high probability of contacting with the ground. Accordingly, the sole portion is rigid and firmly supports the under side of the face portion.

Therefore, by forming the front part 8 and the rear part 9 in the front region 7*b* of the sole portion 4, the support for the under side of the face portion 2 is reduced to allow for the face portion 2 to largely deflect when hitting a ball. As a result, the rebound performance can be effectively improved.

In this embodiment, the contact surfaces sa of the front part 8 and the rear part 9 are straight in vertical cross sections in parallel with the front-back direction, of the club head 1 under its standard state in order to make the front part 8 smoothly movable in the front-back direction.

It is desirable that the front part 8 and the rear part 9 are disposed behind the sweet spot SS such that the sweet spot SS is positioned within the extent of the free rear end 8*a* in the toe-heel direction of the head. Thereby, on center hit, the front part 8 is moved backwards effectively, and the rebound performance can be effectively improved.

In this embodiment, since the front section 11 is laid on the inner surface 8*b* of the front part 8, and the interspace 13 extending in the front-back direction is formed between the free front end 9*a* and the back surface B of the face portion 2, not only the front part 8 is allowed by the interspace 13 to move backward when hitting a ball, but also the front section 11 makes it difficult to cause a gap between the front part 8 and the rear part 9 when the front part 8 hits the ground. Thus, the entering of foreign substances into the hollow (i) can be effectively prevented.

The shortest distance Lb in the front-back direction between the free front end 9*a* and the back surface B is preferably not less than 2 mm, more preferably not less than 3 mm. If the shortest distance Lb is less than 2 mm, there is a possibility that the back surface B of the face portion 2 comes into contact with the free front end 9*a* when hitting a ball, and it becomes difficult to fully improve the rebound performance.

As shown in FIG. 2, the length L1 in the toe-heel direction of the free rear end 8*a* of the front part 8 is preferably set in a range of not less than 18%, preferably not less than 23%, but not more than 70%, more preferably not more than 60% of the length L2 in the toe-heel direction of the club face F. If L1 is less than 18% of L2, it becomes difficult to improve the rebound performance. If L1 is more than 70% of L2, there is a possibility that the rigidity becomes insufficient in the vicinity of the free rear end 8*a* of the front part 8, causing the decreased durability, and further it becomes difficult to achieve mechanical impedance matching between the club head 1 and a ball to improve the rebound performance.

The length in the toe-heel direction of the free front end 9*a* is substantially equal to the length L1.

The length L3 in the front-back direction, of the front section 11 of the rear part 9 or the overlap is set to be more than zero, preferably not less than 1 mm, more preferably not less than 2 mm in order to prevent the entering of foreign substances into the hollow (i).

As shown in FIG. 3, in the direction from the rear to the front of the club head 1, the rear section 12 is bent towards the hollow (i).

In this embodiment, the rear section 12 is bent at a distance backward from the free rear end 8*a* so that a concave portion 14 or space is formed behind the free rear end 8*a* along the outer surface 12*a* of the rear section 12. Such concave portion or space 14 allows for the free rear end 8*a* to move backward when hitting a ball.

In order not to hinder the backward motion of the free rear end 8*a*, the distance Lc in the front-back direction between the free rear end 8*a* and the adjacent bent position 12*e* of the outer surface 12*a* is preferably set to be not less than 2 mm, more preferably not less than 3 mm.

The club face's perimeter region 7 is continuous in the front-back direction excepting the portion where the front and rear parts 8 and 9 are formed.

In this embodiment, as shown in FIG. 2, the club face's perimeter region 7 has continuous parts 10 on the toe-side and on the heel-side of the front and rear parts 8 and 9.

In the continuous part, there is no free ends, but there is a possibility of the existence of ends or edges connected to each other.

In the above embodiment, a set of the front part 8 and the rear part 9 is disposed in the front region 7*b* of the sole portion 4 as explained above.

But, the present invention is not limited to such arrangement. For example, a set of the front and rear parts 8 and 9 can be disposed in any one of the front region 7*a* of the crown portion 3, the heel-side front region 7*c* of the side portion 5 and the toe-side front region 7*d* of the side portion 5.

Further, plural sets of the front and rear parts 8 and 9 can be disposed in the club face's perimeter region 7.

More concrete examples of the overlap structure of the front part 8 and the rear part 9 are described hereunder.

Figure 6:
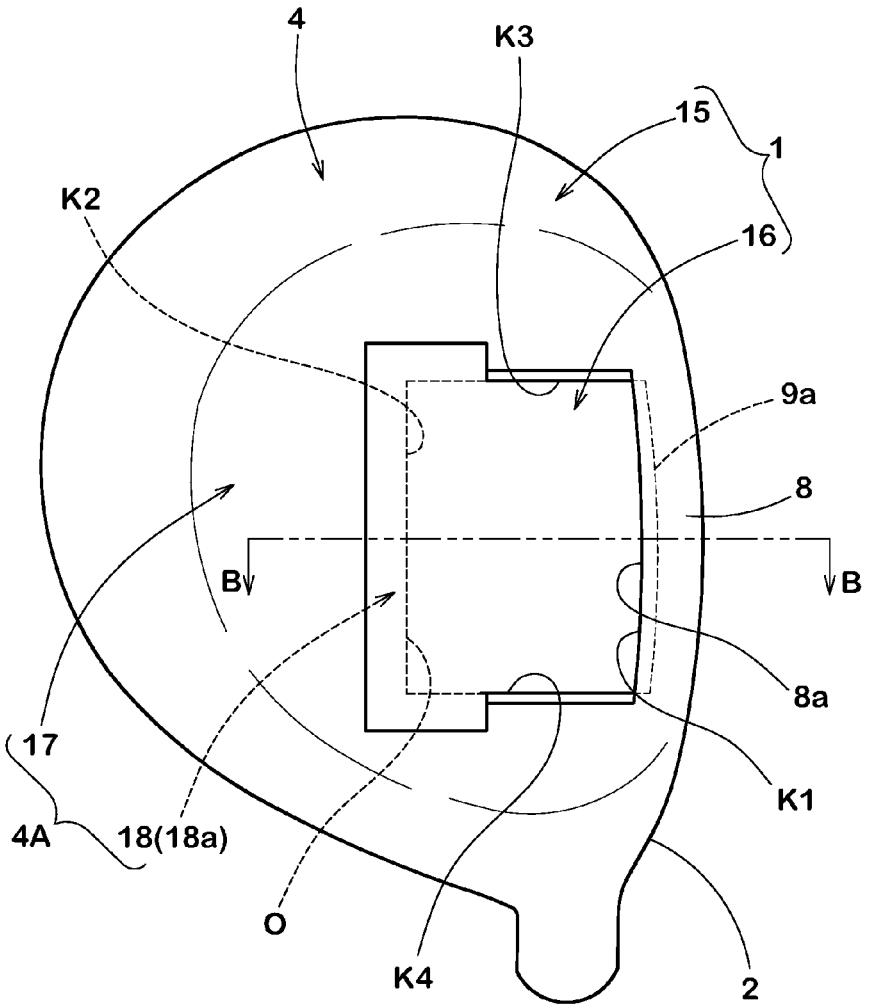
FIG. 6 is a bottom view of the golf club head as second embodiment of the present invention.
Figure 7:
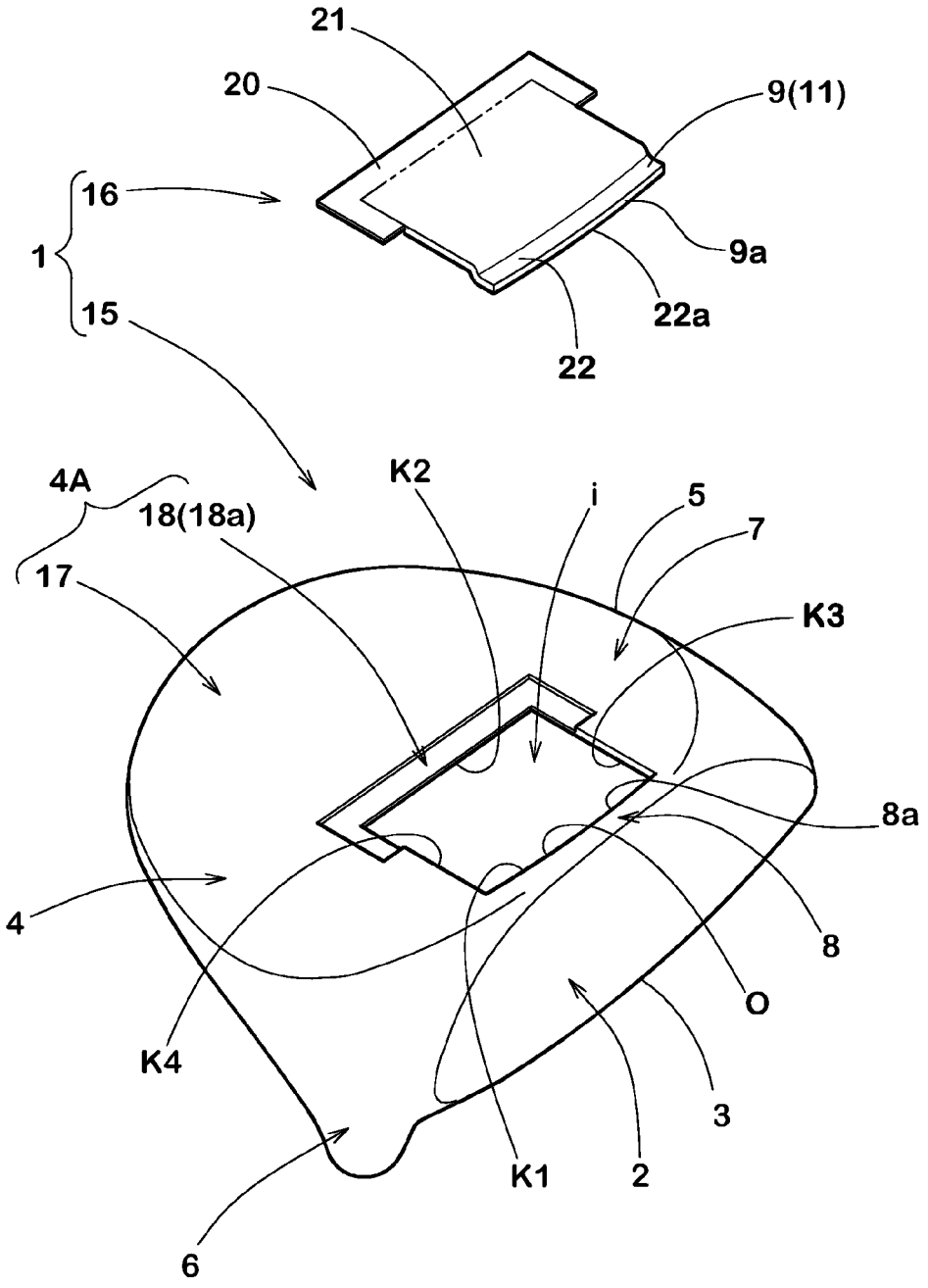
FIG. 7 is an exploded perspective view of golf club head shown in FIG. 6.
Figure 8:
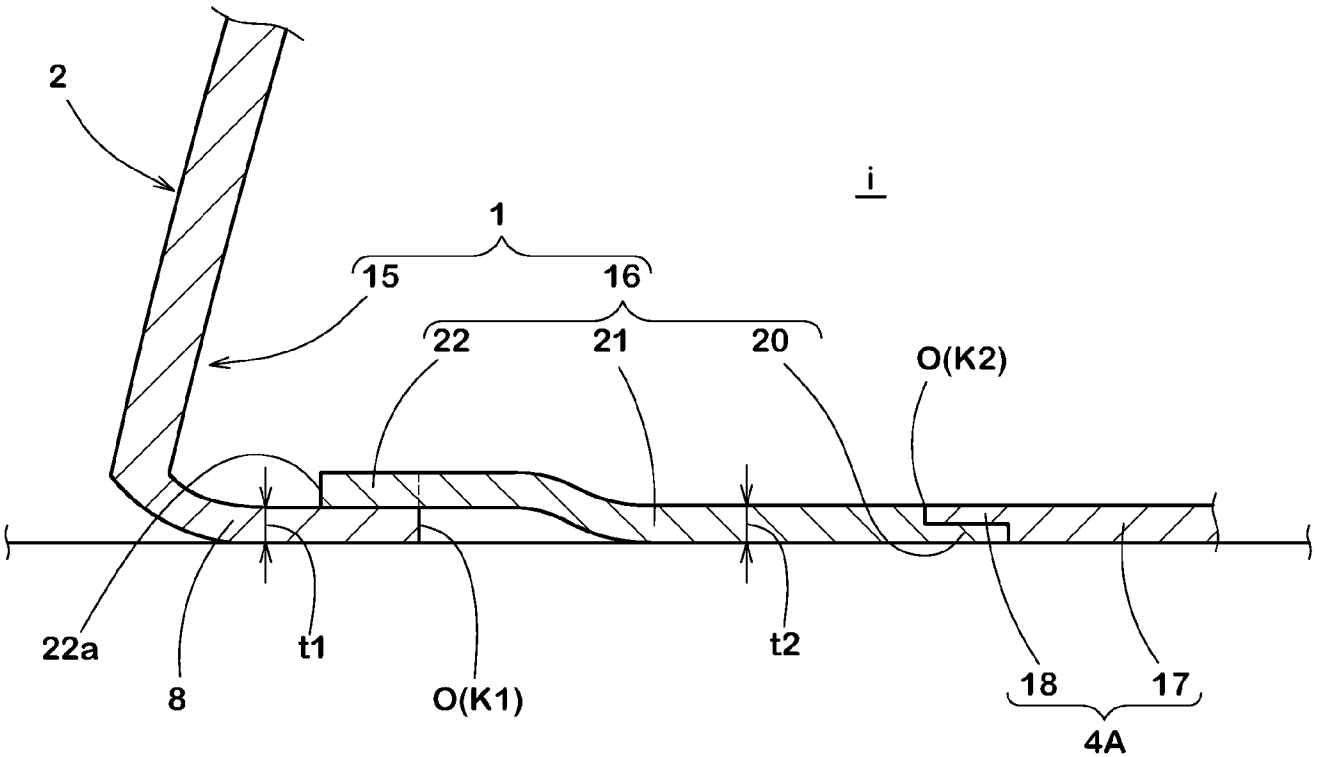
FIG. 8 is a cross sectional view taken along line B-B of FIG. 6.

FIGS. 6-8 show a club head 1 as a second embodiment of the present invention.

In this embodiment, the club head 1 comprises
a first head member 15 having an opening O, and
a second head member 16 closing the opening O.

The first head member 15 includes the face portion 2, the crown portion 3, the side portion 5, the hosel portion 6, and a major part 4A of the sole portion 4 provided with the opening O.

The opening O is formed in the club face's perimeter region 7. The opening O in this example is rectangular and has a front edge K1, a rear edge K2, a toe-side edge K3 and a heel-side edge K4.

The front edge K1 and the rear edge K2 are substantially parallel with the toe-heel direction of the head. The toe-side edge K3 and the heel-side edge K4 are substantially parallel with the front-back direction of the head.

As shown in FIG. 7, the major part 4A comprises a part 17 forming a part of the outer surface of the sole portion 4, and a supporting part 18 whose outer surface sinks toward the hollow (i) steppedly from the part 17.

In this embodiment, the above-mentioned front part 8 is a laterally-extending narrow area of the major part 4A formed between the face portion 2 and the opening O, and the free rear end 8*a* of the front part 8 is the front edge K1 of the opening O.

The second head member 16 is platy and fixed to first head member 15 so as to substantially close the opening O. As shown in FIG. 7, the second head member 16 is composed of a part 20 overlapped with the supporting part 18, a part 21 closing the opening O, and a part 22 protruding forward from the closing part 21.

The second head member 16 is disposed in the opening O such that the protruding part 22 overlaps with the front part 8 on its inner surface 8*b* side. Thus, the front section 11 of the rear part 9 is formed by the protruding part 22, and the free front end 9*a* is formed by the front edge 22*a* of the protruding part 22.

The overlapped part 20 is fixed to the supporting part 18, and the side edges of the closing part 21 are fixed to the toe-side edge K3 and the heel-side edge K4.

Thus, excepting the free front end 9*a*, the perimeter of the second head member 16 is fixed to the first head member 15. The second head member 16 can be fixed to the first head member 15 by the use of an adhesive agent. But, preferably they are fixed by welding.

Figure 9:
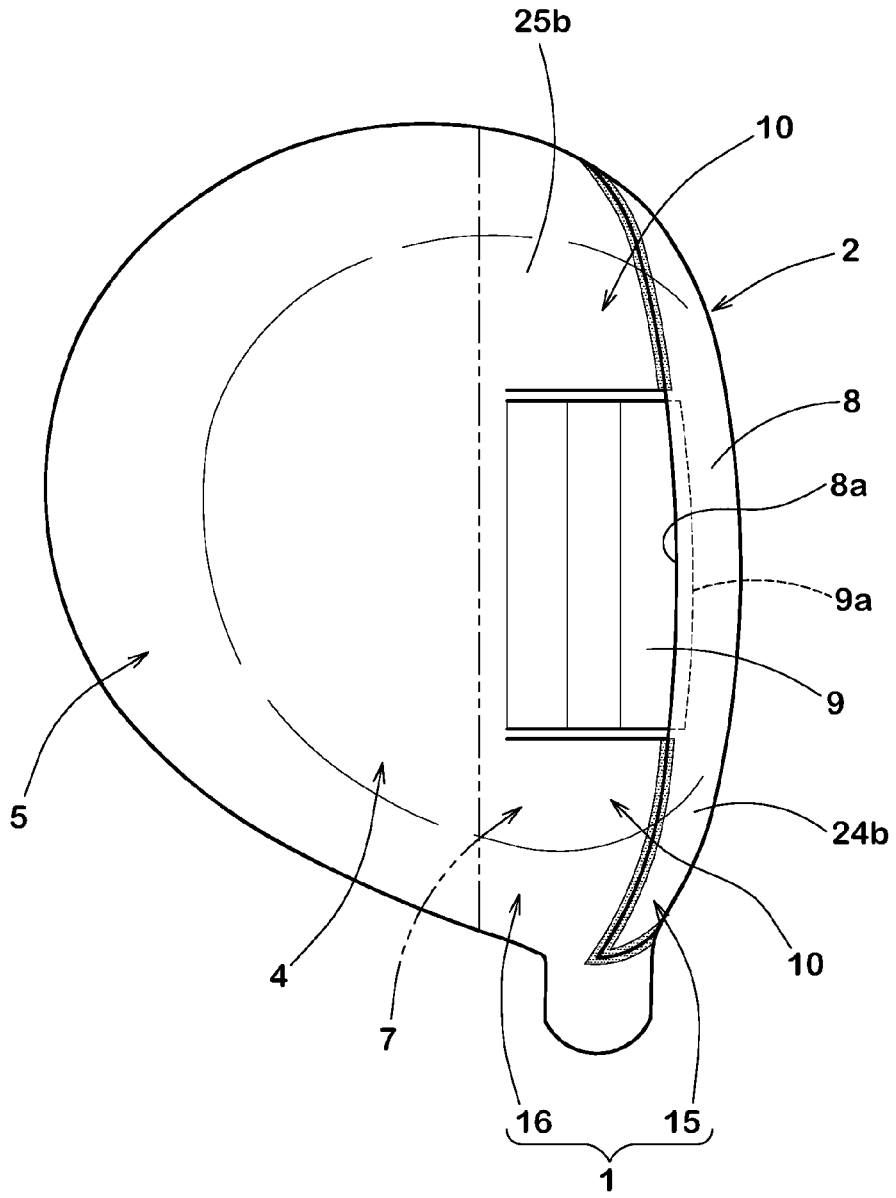
FIG. 9 is a bottom view of a golf club head as a third embodiment of the present invention.
Figure 10:
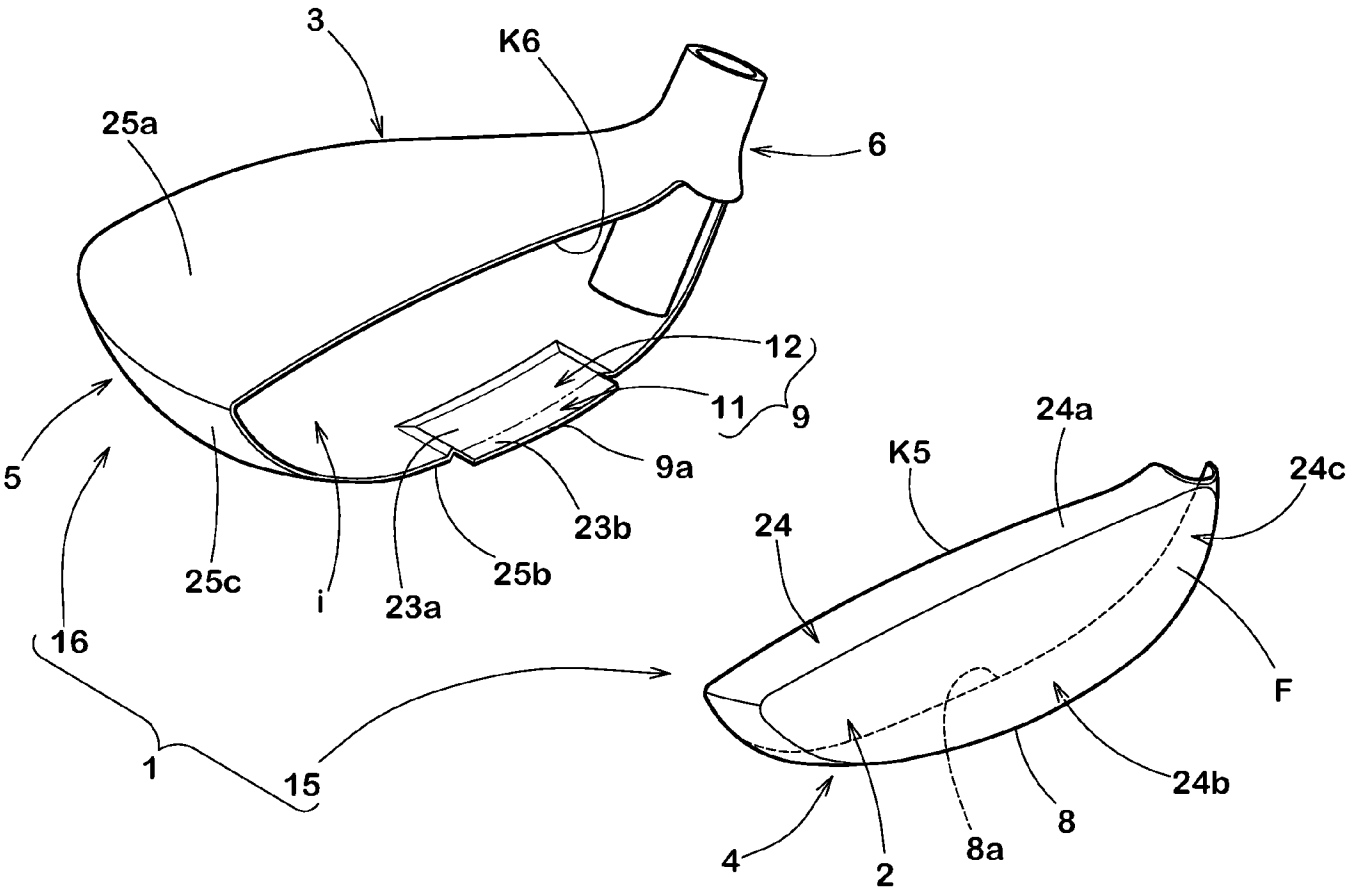
FIG. 10 is exploded perspective view of the golf club head shown in FIG. 9.

FIG. 9 and FIG. 10 show a club head 1 as a third embodiment of present invention.

In this embodiment, the club head 1 comprises a cup-shaped first head member 15 and a cup-shaped second head member 16 which are fixed to each other to form the hollow (i).

The first head member 15 is to form a front part of the club head 1, and in this embodiment, includes the face portion 2 and a turnback 24.

The turnback 24 extends backward from the face portion 2 so as to form the club face's perimeter region 7.

The turnback 24 includes a crown-side turnback 24*a* forming a front part of the crown portion 3, a sole-side turnback 24*b* forming a front part of the sole portion 4, and a side-side turnback 24*c* forming a front part of the side portion 5.

Thus, the first head member 15 has a cavity opening toward the back side of the club head, and has the rear edge K5 around the opening.

The sole-side turnback 24*b* has a part not fixed to the second head member 16 as the front part 8. Thus, the free rear end 8*a* is formed by a part of the rear edge of the sole-side turnback 24*b*.

The second head member 16 is to form a rear part of club head 1. As shown in FIG. 10, the second head member 16 includes the hosel portion 6, a crown rear part 25*a* of the crown portion 3, a sole rear part 25*b* of the sole portion 4, and a side rear part 25*c* of the side portion 5. Thus, the second head member 16 has a cavity opening toward the front side of the club head, and has the front edge K6 around the opening.

The sole rear part 25*b* is provided with a concave portion 23*a* on the outside and a lip 23*b* protruding forward from the concave portion 23*a*. The concave portion 23*a* forms the rear section 12 of the rear part 9. The protruding lip 23*b* forms the front section 11 of the rear part 9. The front edge of the protruding lip 23*b* forms the free front end 9*a*.

The crown portion 3 of the club head 1 is formed by the crown-side turnback 24*a* and the crown rear part 25*a* which are united with each other.

The sole portion 4 is formed by the sole-side turnback 24*b* and the sole rear part 25*b* which are united with each other excepting the lip 23*b*.

The side portion 5 is formed by the side-side turnback 24*c* and the side rear part 25*c* which are united with each other.

Preferably, the first head member 15 is welded to the second head member 16. In FIG. 9, the welded parts are shaded.

Figure 11:
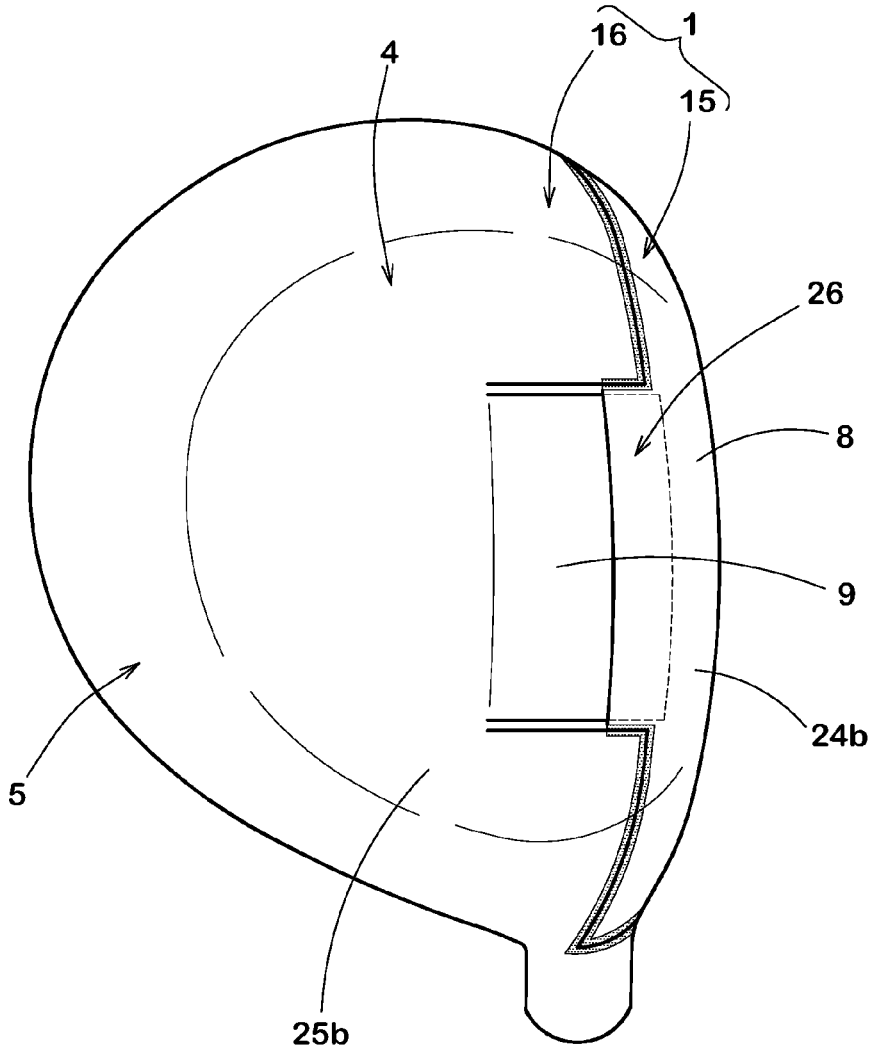
FIG. 11 is a bottom view of a golf club head showing a modification of the third embodiment.

FIG. 11 shows a modification of the third embodiment, wherein the first head member 15 is modified otherwise the head is the same as above.

In this embodiment, the sole-side turnback 24*b* of the first head member 15 is provided in the middle of its length in the toe-heel direction with a backwardly protruding portion 26. This portion 26 forms the above-mentioned front part 8.

The second head member 16 is same as that shown in FIGS. 9-10. In FIG. 11, the welded parts of the first head member 15 and the second head member 16 are shaded.

Figure 12:
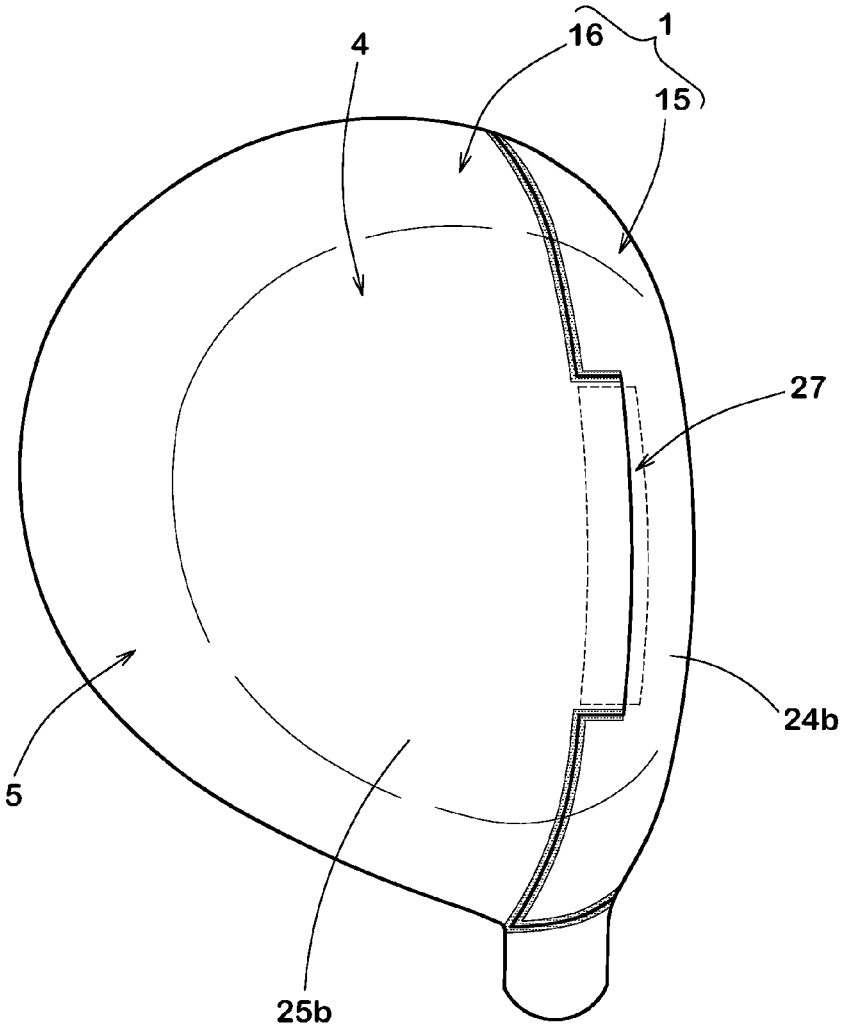
FIG. 12 is a bottom view of a golf club head showing another modification of the third embodiment.

FIG. 12 shows another modification of the third embodiment, wherein both of the first head member 15 and the second head member 16 are modified from those shown in FIGS. 9-10.

In this embodiment, the sole-side turnback 24*b* of the first head member 15 is provided in the middle of its length in the toe-heel direction with a forwardly denting concave portion 27. The above-mentioned front part 8 is formed by a part of the sole-side turnback 24*b* on the front side of the concave portion 27. The sole rear part 25*b* of the second head member 16 is provided with the lip 23*b* protruding forward from the front edge K6. But, The concave portion 23*a* of the sole rear part 25*b* is not formed in this embodiment.

In FIG. 12, the welded parts of the first head member 15 and the second head member 16 are shaded.

In the structures shown in FIG. 11 and FIG. 12, in comparison with the structures shown in FIG. 9, the length of the welded parts can be increased.

Figure 13A:
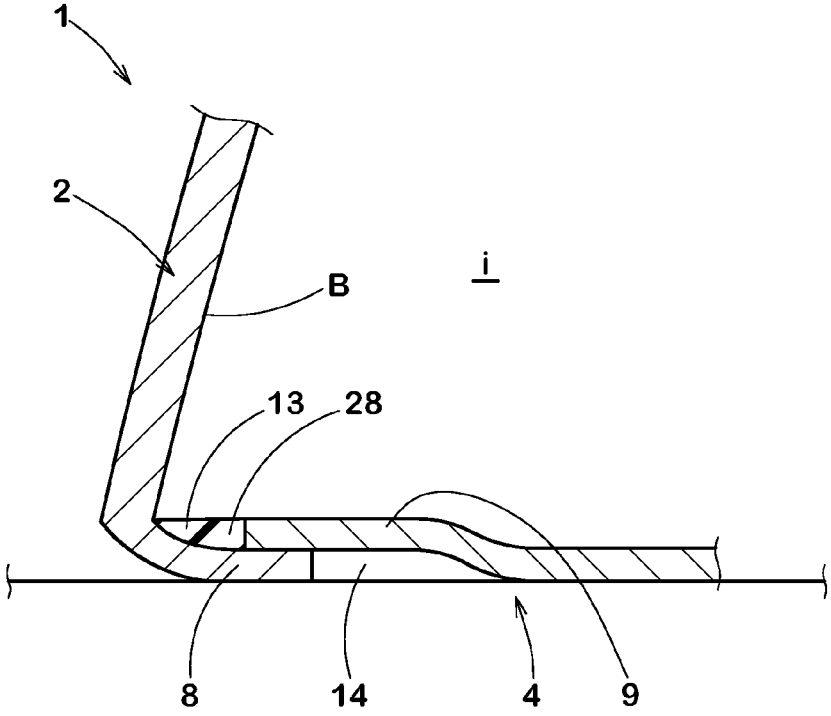
FIG. 13(*a*) and FIG. 13(*b*) are cross sectional views of the overlap structure of the front part and the rear part provided with an elastic material.
Figure 13B:
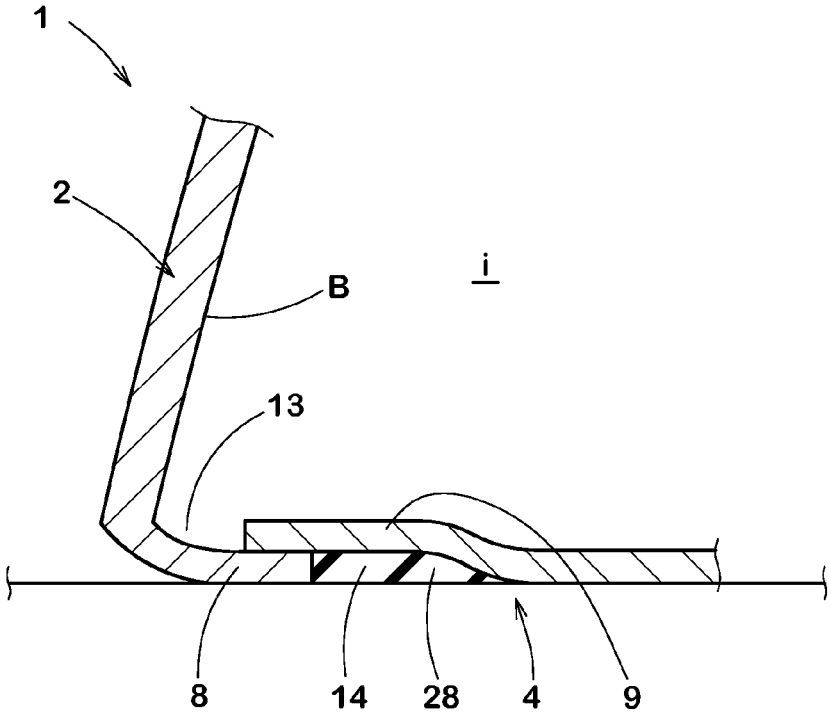

In the case of the rear part 9 whose the front section 11 is laid on the inner surface 8*b* of the front part 8 as shown in FIG. 13(*a*), an elastic material 28 may be disposed in the interspace 13 formed between the free front end 9*a* and the back surface B of the face portion 2.

Such elastic material 28 resists the backward motion of the front part 8, therefore, it is possible to adjust the amount of the backward motion.

Further, the elastic material 28 can seal a possible gap between the front part 8 and the rear part 9, therefore, the entering of foreign substances into the hollow (i) can be absolutely prevented.

Further, as shown in FIG. 13(*b*), the elastic material 28 may be disposed in the concave portion 14. In this example too, the same advantages as the former example can be obtained.

Furthermore, it is also possible to dispose the elastic material 28 in each of the concave portion 14 and the interspace 13.

Such elastic material 28 may be fixed to the club head 1 by the use of an adhesive agent.

Figure 14:
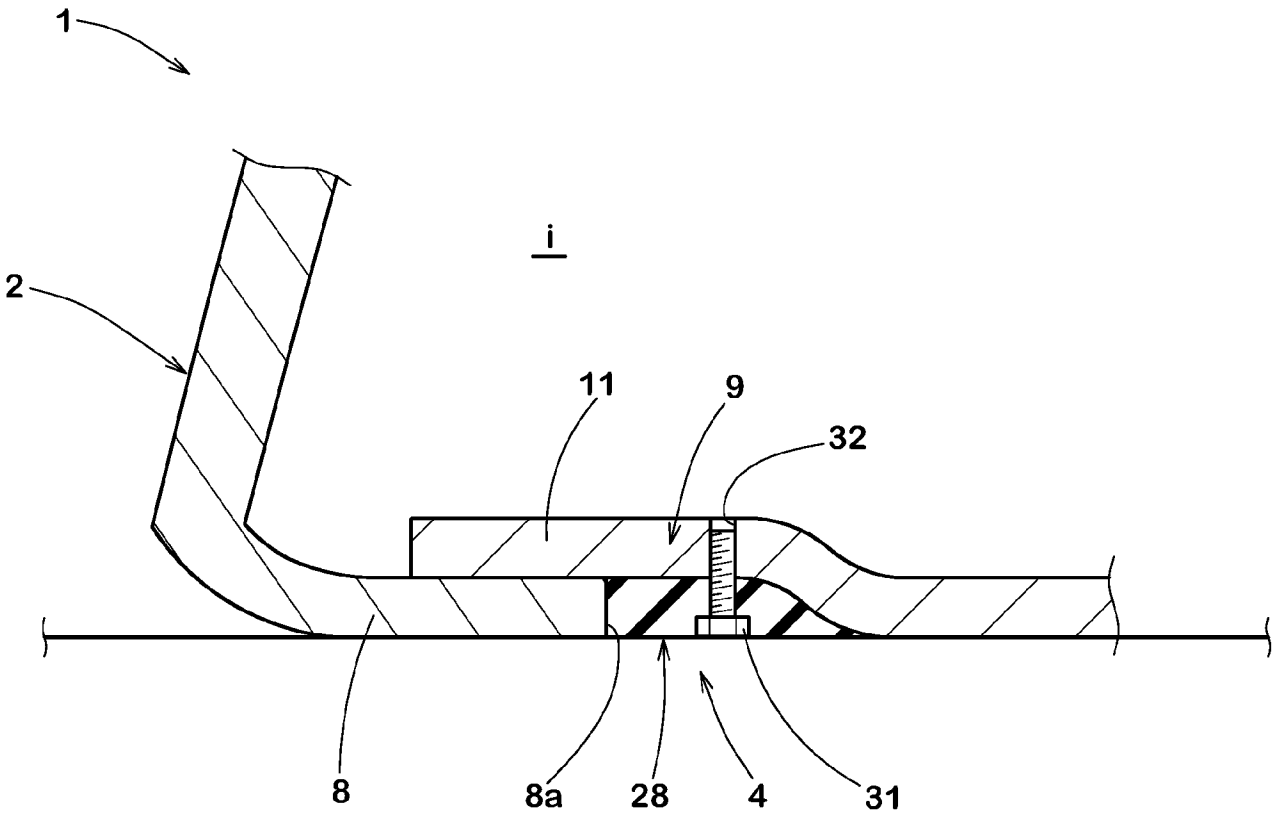
FIG. 14 is a cross sectional view of the overlap structure provided with an exchangeably-attached elastic material.

Further, as shown in FIG. 14, the elastic material 28 may be attached to the club head 1 by the use of screw holes 32 formed in the rear part 9 and screws 31.

In this case, the elastic material 28 is exchangeable for another elastic material 28 having a different elastic modulus. Therefore, the resistance to the backward motion of the front part 8 can be changed to adjust the deflection of the face portion 2.

Furthermore, it is also possible to form the elastic material 28 by filling a fluid material which sets and shows resilience such as a sealant material and adhesive agent.

The contact surfaces sa of the front part 8 and the rear part 9 can be straight in vertical cross sections in parallel with the front-back direction of the club head 1 under its standard state as explained above.

Figure 15:
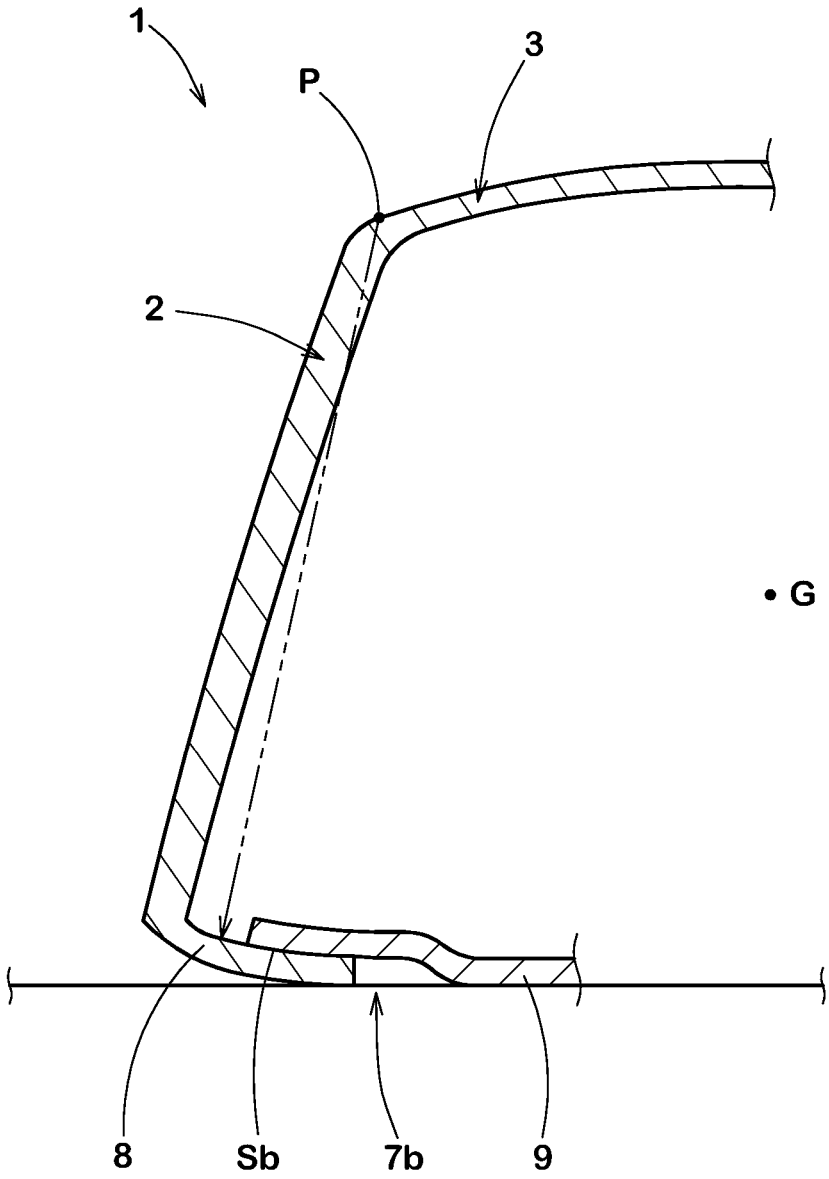
FIG. 15 is a cross sectional view of another example of the overlap structure in which the contact surfaces of the front part and the rear part is a circular arc in the vertical cross section of the head under its standard state which is parallel with the front-back direction and includes the center of gravity of the head.

FIG. 15 shows another example of the contact surfaces Sa. In this example, the contact surfaces Sb of the front part 8 and the rear part 9 are a convex arc swelling towards the outside of the club head.

Preferably, the convex arc is a circular arc whose center is positioned in the vicinity of the corner between the face portion 2 and the crown portion 3.

In the case that the front part 8 and the rear part 9 are formed in the front region 7*b* of the sole portion 4, the front part 8 moves around the upper corner as the fulcrum shaft P when hitting a ball. Therefore, by making the contact surfaces Sb as the convex arc, the front part 8 can smoothly slide on the rear part 9 to further improve the rebound performance.

Figure 16:
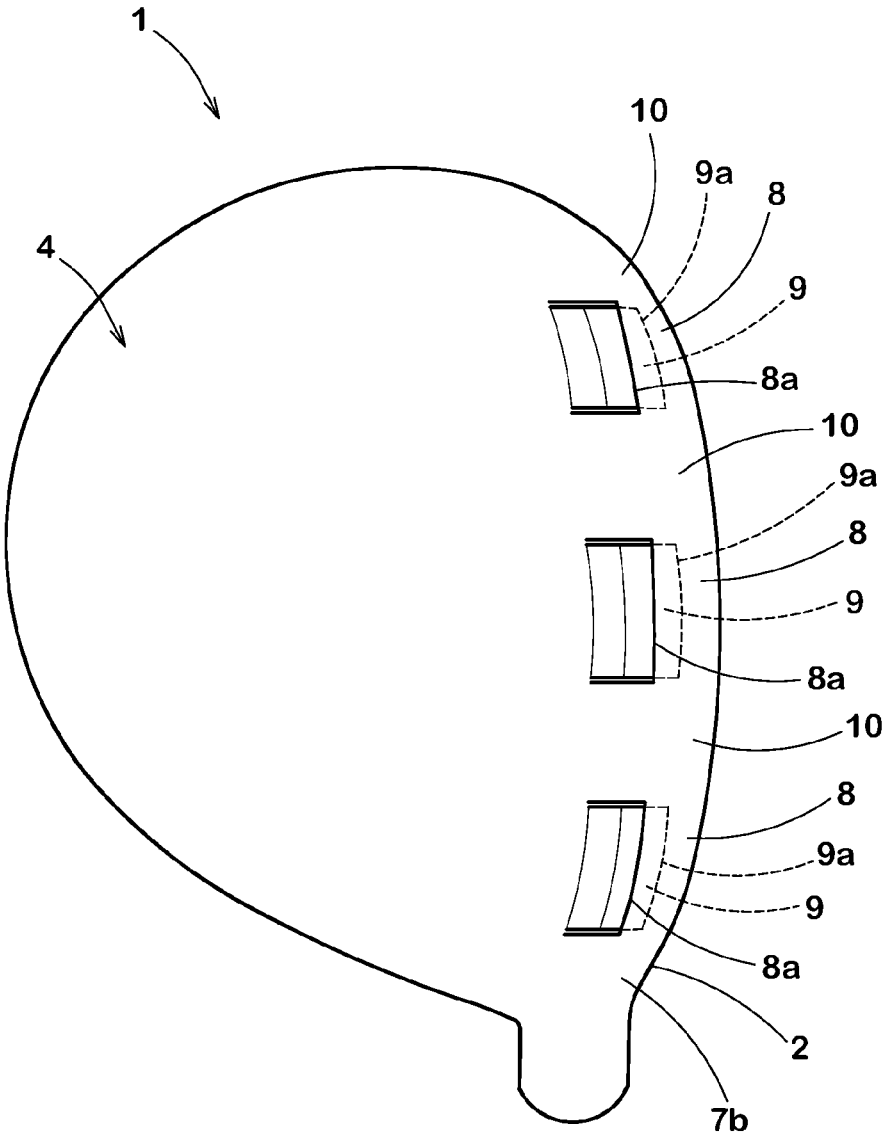
FIG. 16 is a bottom view of a golf club head as a fourth embodiment of the present invention.

FIG. 16 shows a fourth embodiment of the present invention.

In this embodiment, the front region 7*b* of the sole portion 4 is provided with plural sets of the front and rear parts 8 and 9 at intervals in the toe-heel direction. The number of the sets is three in this example, but not limited thereto. Therefore, even if the ball hitting position is off centered in the toe-heel direction, the face portion 2 can deflect largely.

The overlap structure of each set of the front and rear parts 8 and 9 may be of one of the above described types.

Figure 17A:
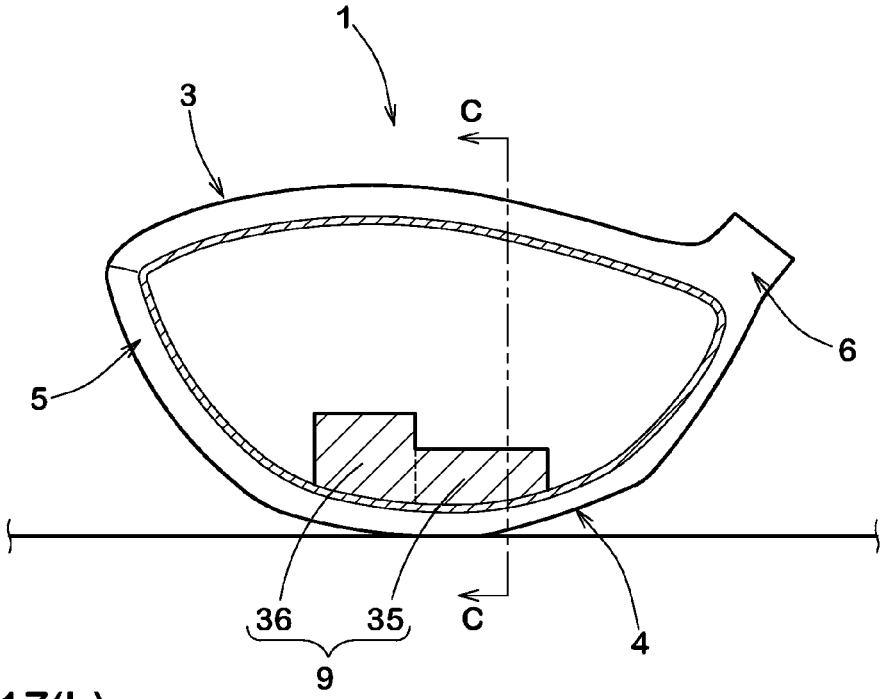
FIG. 17(*a*) is a cross section of a golf club head in parallel with the toe-heel direction showing another example of the rear part of the overlap structure.
Figure 17B:
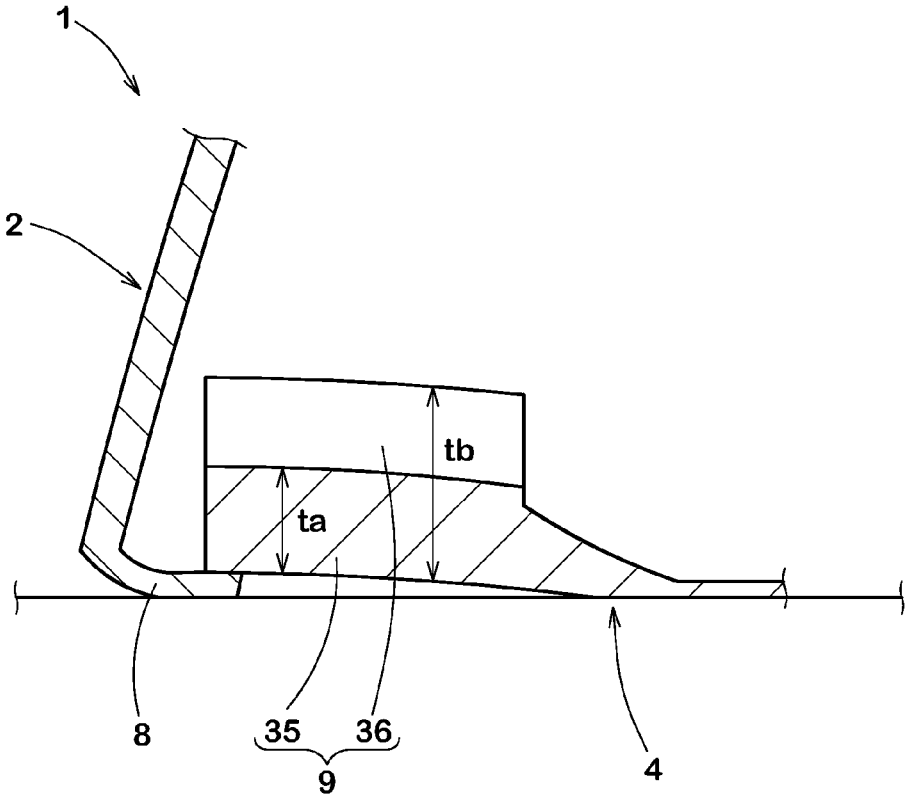

FIGS. 17(*a*) and 17(*b*) shows a modification of the overlap structure in which the front section 11 of the rear part 9 is laid on the inner surface 8*b* of the front part 8. In this example, the rear part 9 has a thickness larger than that of the face portion 2. The rear part 9 comprises a heel-side part 35 having a relatively small thickness to and a toe-side part 36 having a relatively large thickness tb.

Figure 18:
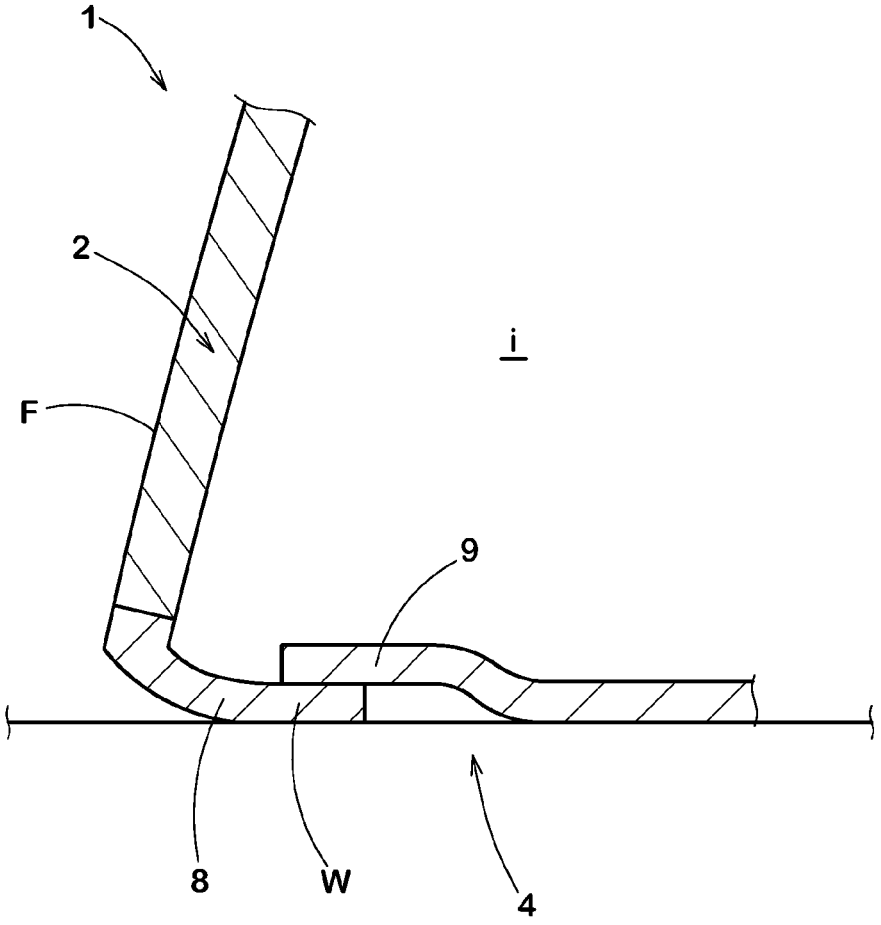
FIG. 18 is a cross sectional view showing another example of the front part of the overlap structure.

FIG. 18 shows an example of the front part 8 which is made of a metal material W having a specific gravity larger than that of the metal material of the rear part 9 to lower the position of the center of gravity of the head.

For example, a tungsten alloy is preferably used as the metal material w of the front part 8.

Comparison Tests

Based on the structure shown in FIGS. 6-8, club heads were experimentally manufactured, changing the length L1 of the free rear end 8*a* as shown in Table 1 (In the comparative example (Ref.), the contact surfaces of the front part and the rear part were welded to each other, therefore length L1=0). Otherwise the club heads were identical.

The following specifications are common to all of the club heads.

lie angle: 58 degrees
loft angle: 15 degrees
mass of club head: 207 g
material of first head member: CUSTOM450 stainless steel (product of Carpenter Technology Corporation)
material of second head member: HT1770M stainless steel (product of Nisshin Steel Co., Ltd.)
thickness t1 of front part: 3.6 mm
thickness t2 of rear part: 1.4 mm The club heads were tested for the rebound performance and durability as follows.

<Rebound Performance Test>

According to the "Procedure for Measuring the Velocity Ratio of a Club Head for Conformance to Rule 4-1e, Appendix II, Revision 2 (Feb. 8, 1999), United States Golf Association", the restitution coefficient was measured at plural measuring points within a 5 mm radius circle centered on the sweet spot of the club face (inclusive of the sweet spot). The maximum restitution coefficient was adopted regardless of the measuring points.

The results are indicated in Table 1 by an index based on the comparative example (Ref) being 100, wherein the larger value is better.

<Durability Test>

Each head was attached to a carbon shaft (Dunlop Sports Co., Ltd. MP-700, Flex S) to make a 43-inch wood-type golf club, and the golf club was mounted on a swing robot (Miyamae Co., Ltd.). Then, the head hit golf balls up to 3000 times at the head speed of 50 meter/second, while visually checking a portion around the front part and the rear part. If damage such as cracks was found, the test was stopped and the number of hits was recorded. The results are indicated in Table 1.

TABLE 1

| Head | Ref. | Ex. 1 | Ex. 2 | Ex. 3 | Ex. 4 | Ex. 5 |
|---|---|---|---|---|---|---|
| Length ratio L1/L2 (%) | — | 48 | 18 | 23 | 60 | 70 |
| Rebound performance | 100 | 102.2 | 100.3 | 100.8 | 101.2 | 100.2 |
| Durability | 3000 | 3000 | 3000 | 3000 | 3000 | 3000 |

While description has been made of preferable embodiments of the present invention, the illustrated embodiments should not be construed as to limit the scope of the present invention; various modifications are possible without departing from the scope of the present invention.

The invention claimed is:

1. A hollow golf club head having an inner cavity and comprising a face portion having a club face for hitting a ball, and a perimeter region extending backwardly of the club head from the peripheral edge of the club face of the face portion so as to surround the face portion, the perimeter region being provided with at least one set of a front part and a rear part, wherein the front part extends backward from the face portion and terminates to have a free rear end, and the rear part extends forward and terminates to have a free front end, wherein the front part and the rear part are overlapped with each other without being fixed to each other so that, relatively to the rear part, the front part is movable in a front-back direction of the club head when hitting a ball, and in the overlap between the front part and the rear part, the opposing surfaces of the front and rear parts closely contact each other so as to substantially close the inner cavity.

2. The golf club head according to claim 1, wherein the club head is composed of a first head member having an opening, and a second head member attached to the first member so as to close the opening, the free rear end of said front part is formed by a part of an edge of the first head member surrounding the opening, and the free front end of said rear part is formed by a front edge of the second head member.

3. The golf club head according to claim 2, wherein
the first head member includes a sole portion of the club head forming a bottom surface of the club head,
said opening is formed in the sole portion, and
said front part is formed by a part of the sole portion between the face portion and the opening.

4. The golf club head according to claim 2, wherein
the first head member is cup-shaped and comprises the face portion and a turnback extending backwardly of the club head to form said perimeter region,
the free rear end is formed by a part of the rear edge of the turnback,
the second head member is cup-shaped, and
said inner cavity of the golf club head is formed by an open cavity of the second head member and an open cavity of the first head member.

5. The golf club head according to claim 4, wherein the turnback include a sole-side turnback provided with said free rear end.

6. The golf club head according to claim 1, wherein the rear part comprises a front section and a rear section, the front section overlapping the front part on the inside of the front part and the rear section extending backwards from the front section so that the free rear end of the front part is not covered with the rear part from the outside of the front part.

7. The golf club head according to claim 6, wherein the rear part is bent towards the inner cavity so that the front section thereof is positioned on the inside of the front part.

8. The golf club head according to claim 6, wherein
a concave portion is formed behind the free rear end of the front part and on the outside of the rear part, and
an elastic material is disposed in the concave portion.

9. The golf club head according to claim 1, wherein in a vertical cross section of the club head which includes the center of gravity of the club head and which is parallel to the front-back direction of the club head, the closely contacting opposing surfaces of the front part and the rear part are a circular arc whose center is positioned in a vicinity of a corner between the face portion and a crown portion of the club head.

* * * * *